United States Patent [19]

Maruta et al.

[11] Patent Number: 4,879,575

[45] Date of Patent: Nov. 7, 1989

[54] COPYING APPARATUS WITH PROVISION FOR DELAYED RESET IN THE EVENT OF PAPER EXHAUSTION

[75] Inventors: Syuzi Maruta, Toyokawa; Masazumi Ito, Toyohashi, both of Japan

[73] Assignee: Minolta Camera Kabushiki Kaisha, Osaka, Japan

[21] Appl. No.: 104,376

[22] Filed: Oct. 5, 1987

[30] Foreign Application Priority Data

Oct. 7, 1986 [JP] Japan ..... 61-238567

[51] Int. Cl.[4] ..... G03G 21/00

[52] U.S. Cl. ..... 355/208; 271/9; 355/314

[58] Field of Search ..... 355/14 R, 3 R, 3 S H, 355/14 S H; 271/9

[56] References Cited

U.S. PATENT DOCUMENTS

| | | | |
|---|---|---|---|
| 4,017,170 | 4/1977 | Komori et al. | 355/3 R |
| 4,054,380 | 10/1977 | Donohue et al. | 355/14 R |
| 4,090,787 | 5/1978 | Hubbard et al. | 355/14 R |
| 4,123,155 | 10/1978 | Hubert | 355/14 R |
| 4,222,660 | 9/1980 | Furuichi et al. | 355/14 R |
| 4,315,685 | 2/1982 | Inuzuka et al. | 355/14 R |
| 4,474,454 | 10/1984 | Sugiura | 355/14 R |
| 4,708,461 | 11/1987 | Okuda et al. | 355/3 X |

FOREIGN PATENT DOCUMENTS 61-11761 1/1986 Japan .

*Primary Examiner*—A. T. Grimley
*Assistant Examiner*—Robert Beatty
*Attorney, Agent, or Firm*—Burns, Doane, Swecker & Mathis

[57] ABSTRACT

A copying apparatus includes a paper storing portion for feeding copy paper toward an image forming portion, a detector for detecting paper empty in the paper storing portion, and an automatic resetting mechanism. The automatic resetting mechanism has two timers for resetting the copy condition to a standard state if a copy instruction is not given within the set period of time. The first timer is set at the end of the copy operation, and the second timer is set upon the detector detecting a paper empty condition, the set period of the second timer being longer than the set period of the first timer. The operator, therefore, will be able to supply copy paper into the empty storing portion before the automatic resetting of the set copy condition.

8 Claims, 11 Drawing Sheets

COPYING APPARATUS WITH PROVISION FOR DELAYED RESET IN THE EVENT OF PAPER EXHAUSTION

FIELD OF THE INVENTION

The present invention relates to a copying apparatus, and more particularly to improvements in an automatic resetting mechanism of a copying apparatus for use in the case of absence of paper.

BACKGROUND OF THE INVENTION

There has been proposed a copying apparatus using an automatic resetting mechanism which resets various modes to the standard mode (for example, with conditions for making a single copy at a magnification of 1X at a medium density.) If any key is not operated within a prescribed period of time after the end of a copying operation or input by any key.

However, when absence of paper (hereinafter referred to as "paper empty") is detected in the conventional copying apparatus, it sometimes happens that the set mode returns to the standard mode because of the lapse of an automatic resetting period before supplying new copy paper in the paper portion by operator. In such a case, it is necessary to set again the desired mode, which is troublesome. If copy operation is started without setting again the desired mode, the copy is made in a wrong manner.

Under such circumstances, U.S. Pat. No. 4,315,685 discloses a copying apparatus in which automatic resetting is prohibited when paper empty is detected. However, this conventional apparatus has a problem. While the operator leaves the apparatus for supplying new copy paper into the empty paper storing portion, other operator is likely to start a copy operation in a wrong mode set by the former operator.

SUMMARY OF THE INVENTION

In view of the above, the primary object of the present invention is to provide an improvement in an automatic resetting mechanism for copying apparatus which operates when paper empty is detected.

The foregoing object can be well fulfilled according to the present invention by providing a copying apparatus comprising:

means for forming an image on copy paper;

means for storing copy paper;

detection means for detecting paper empty in said paper storing means;

input means for inputting a copy condition;

means for giving a copy instruction;

a first automatic resetting timer which is set at the end of the copy operation of said image forming means;

a second automatic resetting timer which is set when said detection means detects the paper empty, the set period of time of second timer means being longer than the set period of time of said first timer means; and means for automatically resetting the input copy condition to a predetermined state if a copy instruction or any copy condition is not input within the set period of time of said first or second timer means.

DESCRIPTION OF THE PREFERRED EMBODIMENTS

Figure 1:
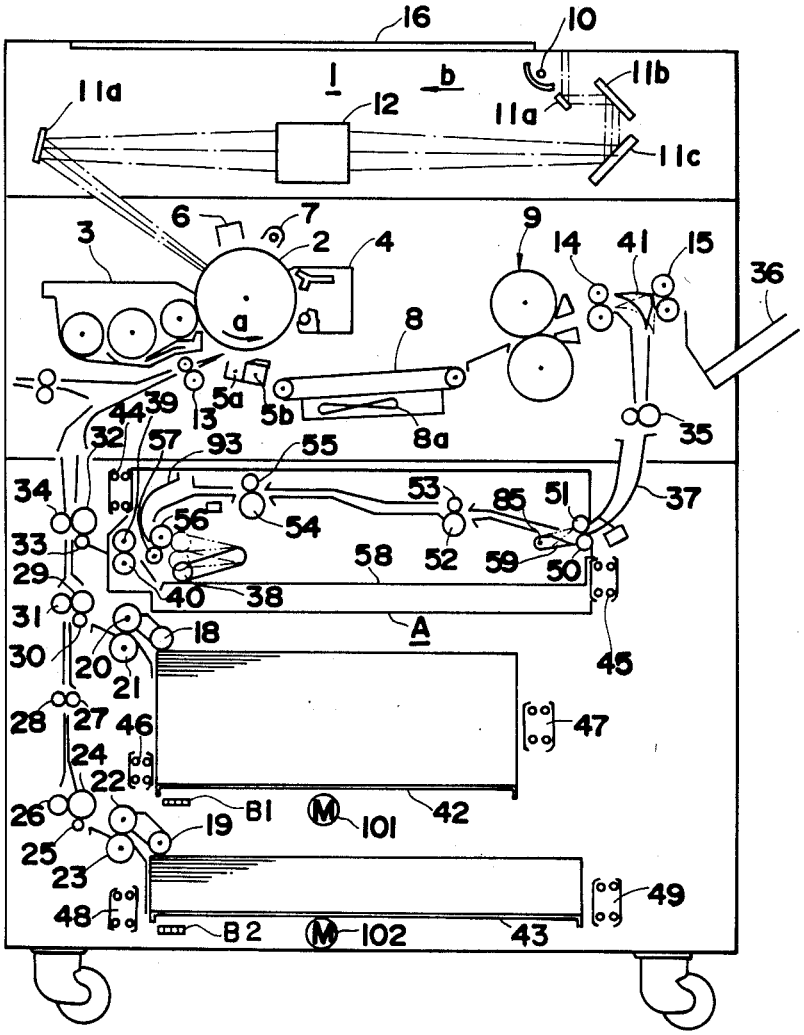
FIG. 1 is an illustration showing an outline of a mechanism of embodiment of a copying apparatus according to the present invention.

In the following, a copying apparatus of an embodiment of the present invention will be described with reference to the attached drawings.

First, referring to FIG. 1, construction and operation of this copying apparatus will be described. This copying apparatus comprises: copy paper storing portions 42 and 43, and an intermediate tray unit A in a lower portion thereof; an image forming portion including a photoconductive drum 2 in an intermediate portion thereof; and an optical system 1 in an upper portion thereof. When a sheet of copy paper onto which a first copy operation has been effected is fed to the intermediate tray unit A, duplex copying (namely, copying of both faces of a sheet) or composite copying can be effected.

The photoconductive drum 2 is rotatable in a direction of the arrow a and, around the photoconductive drum 2, there are provided a sensitizing charger 6, a developing unit 3 of a magnetic brush type, a transfer charger 5*a*, a separation charger 5*b*, a cleaner 4 of a blade type, and an eraser lamp 7. When the photoconductive drum 2 rotates in the direction of the arrow a, it is uniformly sensitized by the sensitizing charger 6 and undergoes an exposure from the optical system 1 so that a latent electrostatic image is formed. This latent electrostatic image is developed by the developing unit 3 so that a toner image is obtained.

The optical system 1 is capable of scanning a document in a direction of the arrow b under a document glass table 16. The optical system 1 comprises an exposure lamp 10, movable mirrors 11*a*, 11*b* and 11*c*, a lens 12 and a fixed mirror 11*d*. The exposure lamp 10 and the movable mirror 11*a* move together in the direction of the arrow b at a speed V/m (m: a copying magnification) with respect to a rotation speed V of the photoconductive drum 2 (constant irrespective of whether an equal-scale magnification or a variable-scale magnification is selected), and the movable mirrors 11*b* and 11*c* move together in the direction of the arrow b at a speed V/2m.

On the other hand, the copy paper storing portions comprise the upper elevator-type storing portion 42 and the lower elevator-type storing portion 43. The storing portions 42 and 43 are driven by an upper paper feed elevator lift-up motor 101 and lower paper feed elevator lift-up motor 102, respectively, so that sheets of copy paper contained therein are pushed upward when the sheets of copy paper are being fed. The storing portions 42 and 43 can be taken out in a direction from the main body of the copying apparatus to the front face thereof by means of rails 46 and 47, and rails 48 and 49, respectively.

Either the sheets of copy paper in the storing portion 42 or the sheets of copy paper in the storing portion 43 are delivered one by one selectively through delivery rollers 20 and 21 or delivery rollers 22 and 23 by rotation of a paper feed roller 18 or a paper feed roller 19 so as to be transported to timing rollers 13 through transport rollers 29, 30 and 31, and rollers 32 and 34 (in the case of the sheets in the storing portion 42) or through transport rollers 24, 25 and 26, and rollers 27 and 28 (in the case of the sheets in the storing portion 43).

The transported sheet is temporarily stopped by the timing rollers 13 and then it is sent out to a transfer portion in synchronism with the image formed on the photoconductive drum 2. Consequently, the above-mentioned toner image is transferred onto the sheets by discharge of the transfer charger 5*a* and the sheet is separated from the surface of the photoconductive drum 2 by discharge of the separation charger 5*b*. Then, the sheet is transported to a fixing device 9 by means of a transport belt 8 comprising an air suction means 8*a* so that a fusing and fixing process is applied to the toner image.

A lever 41 for selecting a transport path of the copy paper is provided between transport rollers 14 adjacent to an outlet of the fixing device 9 and outlet rollers 15. If the sheet is to be discharged immediately, the lever 41 is set in a position as shown by the chained lines in FIG. 1 so that the sheet sent out from the fixing device 9 is discharged from the outlet rollers 15 onto a tray 36. In the case of duplex copying or composite copying to be described in detail below, the lever 41 is set in a position shown by the solid lines so that the sheet is sent from transport rollers 35 through a guide plate 37 into the intermediate tray unit A to be described below in detail.

On the other hand, the cleaner 4 removes the remaining toner from the photoconductive drum 2 after the transfer and the remaining electric charge is removed by applying light from the eraser lamp 7 to the drum 2 so that the drum 2 is prepared for the subsequent copy operation.

Now, an outline of construction of the intermediate tray unit A will be described.

The intermediate tray unit A is formed as a unitary body comprising a selection block, a transfer block, a reverse block, an intermediate tray block and a re-feed block. Both ends of the unit A are supported by the rails 44 and 45. This unit A can be taken out from the main body of the copying apparatus in the direction of the front face, namely, in a direction perpendicular to a paper feeding direction.

The selection block has transport rollers 50 and 51, and a selection lever 59. The selection block may be provided in the main body of the copying apparatus not in the intermediate tray unit A.

The transport block comprises transport rollers 52, 53, 54 and 55, and a guide plate.

The reverse block comprises a reverse transfer rollers 56 and 57, and a reverse guide 93. This reverse block reverses the moving direction of the copy paper transported by the transport block to send it onto an intermediate tray 58.

The re-feed block comprises a holder, rollers 38, 39 and 40, and a guide plate. This re-feed block feeds again the sheets of copy paper on the intermediate tray 58 one by one for copy operation.

For the purpose of performing duplex copying or composite copying, either a mode selection key 303 or a mode selection key 304 on an operation panel 300 (shown in FIG. 2) is pressed to select either copy mode. Then, the selection lever 41 moves to be in the position shown by the solid lines in FIG. 1 so that the sheet of copy paper having one face or an area already printed is transported by the guide plate 37 from the transport rollers 35 to the transport rollers 50 and 51.

In the duplex copy mode, the selection lever 59 rotatable around an axis 85 is set in a position shown by the solid lines in FIG. 1. As a result, the sheet of copy paper is moved over the upper surface of the lever 59 and sent to the transfer block, and it is guided by the guide plate and transported to the left in FIG. 1 by the transport rollers 52, 53, 54 and 55. Then it is turned by the reverse transport rollers 56 and 57, and the reverse guide 93 so that it is sent onto the intermediate tray 58 with the face already printed being directed upward. Then, the sheets thus transported are set in order so as to be fed again one by one by clockwise rotation of the re-feed roller 38.

On the other hand, in the composite copy mode, the selection lever 59 is set in a position shown by the chained lines in FIG. 1 so that the sheet of copy paper introduced by the transport rollers 50 and 51 is immediately guided along the lower surface of the lever 59 and is sent directly onto the intermediate tray 58 with the face already printed being directed downward. Then, in the same manner as in the duplex copy mode, the sheets of copy paper thus sent are fed again one by one by clockwise rotation of the re-feed roller 38.

The sheets of copy paper to be fed again are delivered through the delivery rollers 39 and 40 and transported to the timing rollers 13 through the transport rollers 32, 33 and 34, so that a duplex copy or composite copy is applied to the sheets in the same manner as in the standard copy process. The re-feed roller 38 can be positioned at three levels (as shown by the chained lines, the dotted lines and the solid lines in FIG. 1). When the sheets of copy paper are sent onto the intermediate tray 58, the roller 38 is positioned at the upper or intermediate level and when the sheets of copy paper are fed again, it is positioned at the lowest level so as to press the sheets on the intermediate tray 58 by a suitable pressure.

The paper storing portions 42 and 43 are provided with paper empty sensors B1 and B2, respectively, for detecting absence of paper therein.

Figure 2:
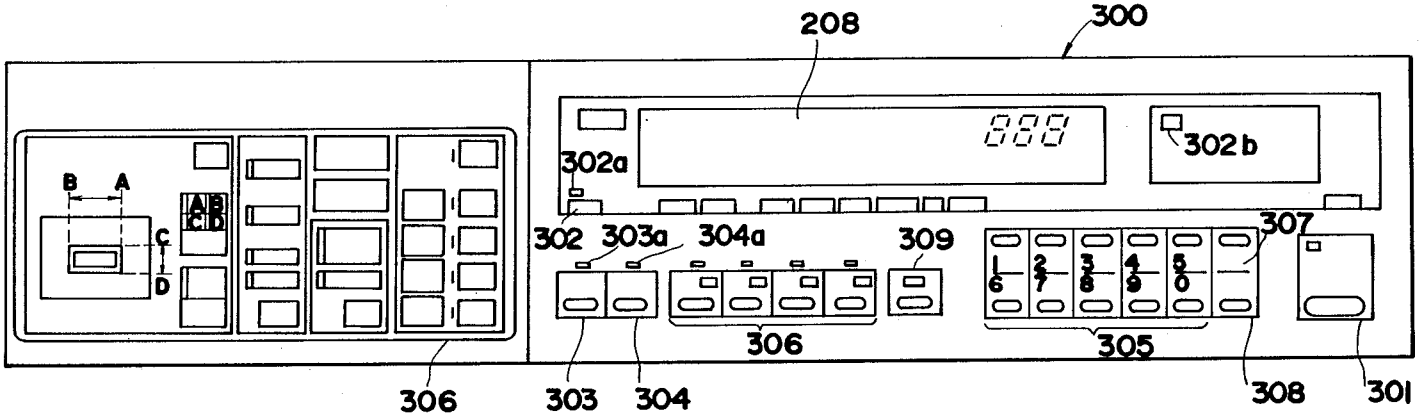
FIG. 2 is an illustration of an operation panel of the copying apparatus shown in FIG. 1.

FIG. 2 is an illustration show in the operation panel of the above described copying apparatus.

This operation panel comprises a print key 301, a paper size selection key 309, a magnification setting 306, a numerical value input ten key 305, an interruption key 307, a clear stop key 308, a duplex mode key 303 with a display element 303*a*, a composite mode key 304 with a display element 304*a*, a display portion 208, a standard feed mode 302 with a display element 302*a*, and an alarm display element 302*b* for displaying existence of remaining sheets in the intermediate tray, and the like.

Figure 3:
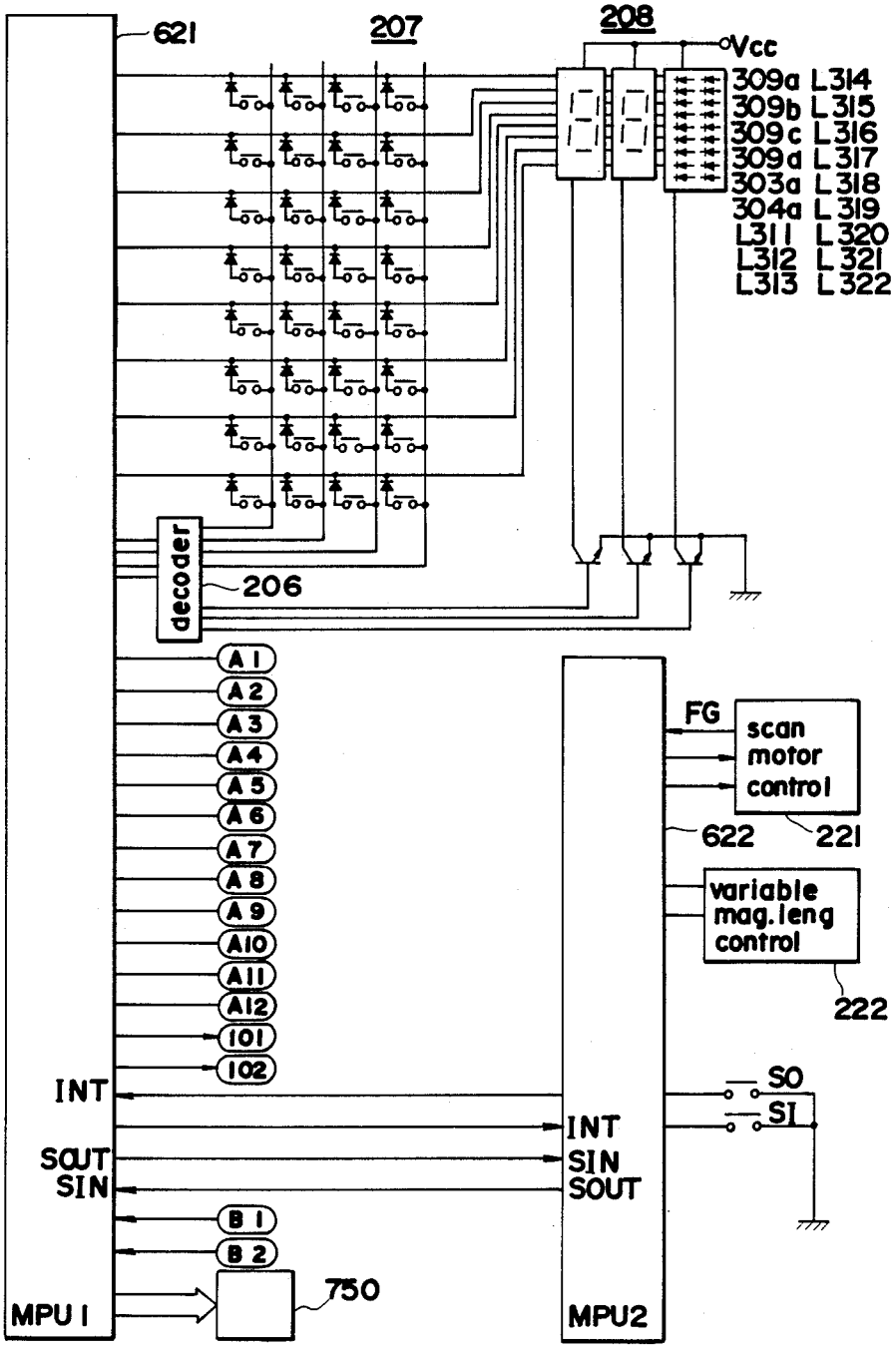
FIG. 3 is a circuit diagram showing an electric configuration of the copying apparatus shown in FIG. 1.

In the following, a control circuit of this copying apparatus will be described with reference to FIG. 3.

This control circuit mainly comprises a first microprocessing unit (MPU) 621 for control of copy operation and a second MPU 622 for control of the optical system, those MPUs 621 and 622 being connected with each other to be in synchronism. The first MPU 621 is connected with a switch matrix 207 where the operation keys on the operation panel 300 and the paper empty sensors B1, B2 are arranged.

Output terminals A1 to A12 of the first MPU 621 are connected with a main motor, a development motor, a feed clutch, a re-feed clutch, solenoids for selection of the levers 41 and 59, etc. Those components are turned on and off by control based on signals from the above-mentioned switch matrix 207. Output terminals 101 and 102 of the first MPU 621 are connected with the elevator drive motors for the upper and lower storing portions 42 and 43. The first MPU 621 is further connected with various LEDs for the display portion 208, etc, through a decoder 206 so as to control turning on and off of those LEDs.

On the other hand, the second MPU 622 is connected with a drive control portion 221 for a DC motor for scanning of the optical system, a drive control portion 222 for a stepping motor for movement of the lens, a fixed position switch S0 of the optical system 1, a timing switch S1, etc.

Now, operation of the apparatus of this embodiment will be described.

Figure 4:
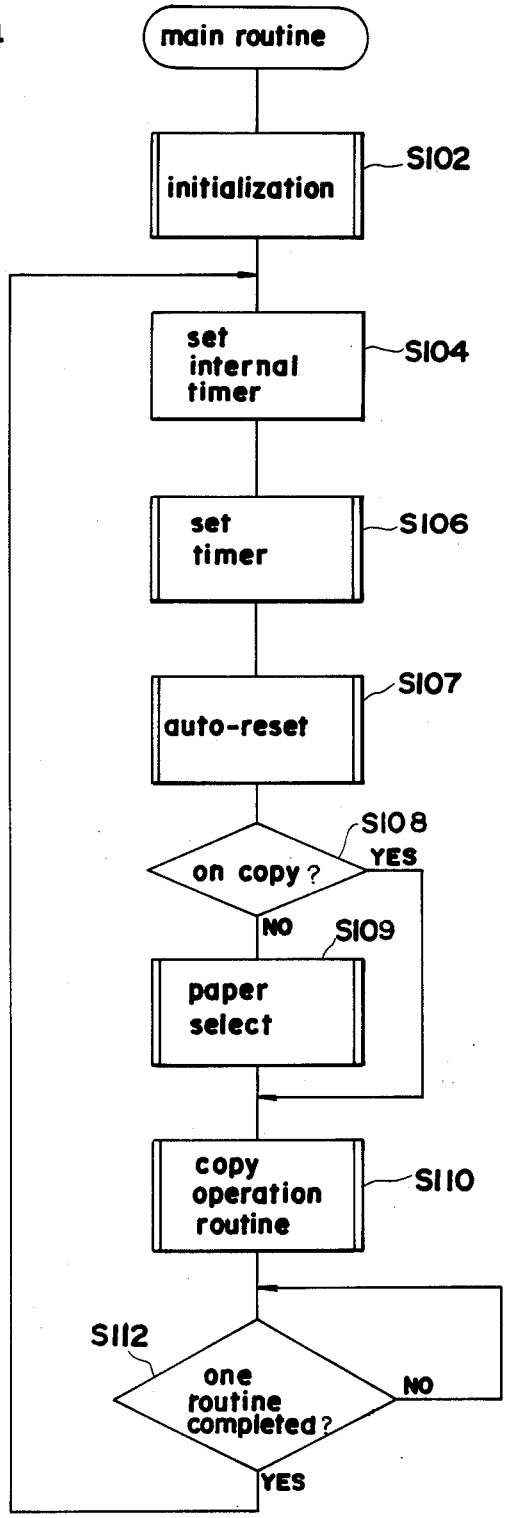
FIG. 4 is a flowchart showing a main routine of a first microprocessing unit of the copying apparatus shown in FIG. 1.

FIG. 4 is a flowchart showing a main routine of the first MPU 621 in the apparatus of this embodiment.

First, initialization is performed in the step S102. For example, a RAM, flags and the like are initialized and the copy mode is set to a first reference mode. The first reference mode is, for example, set to conditions in which copy of one face is selected, a magnification is 1, the number of copy sheets is 1 and the size of copy paper is A4.

Then, in the step S104, an internal timer for defining a length of time for one routine is set.

Subsequently, procedures in the steps S106 to S110 are executed. After that, there is a wait for an end of the internal timer set in the step S104 and then the routine returns to the step S104.

The step S106 is related with processing for setting an automatic resetting timer, which will be described below in detail with reference to FIG. 5.

The step S107 is related with automatic resetting processing, which will be described in detail with reference to FIG. 6.

It is determined in the step S108 whether the copy operation is being executed or not. If it is not being executed, the routine proceeds to the step S109.

The step S109 is related with selecting one of copy paper feed section, which will be described in detail with reference to FIG. 8.

The step S110 is related with copy operation processing, which will be described in detail with reference to FIGS. 9A to 9D.

Figure 5:
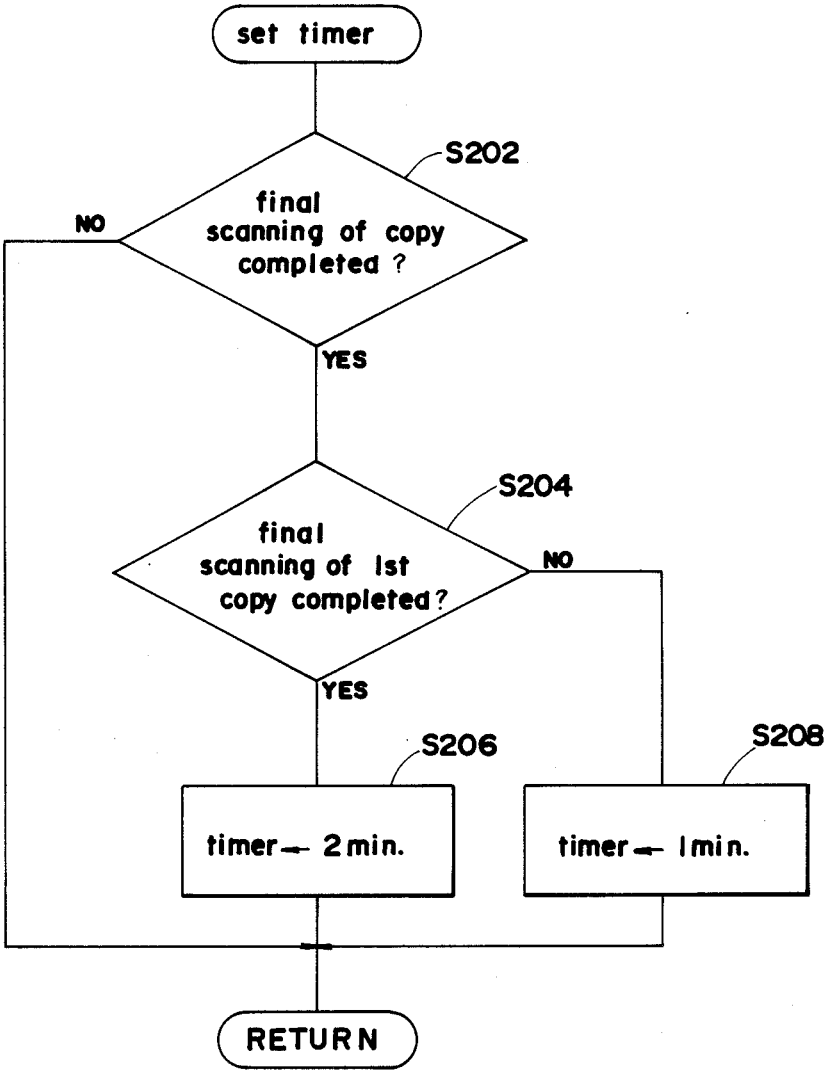
FIG. 5 is a flowchart showing the details of the step S106 shown in FIG. 4.

FIG. 5 is a flowchart for explaining the details of the step S106.

First, it is determined in the step S202 whether the final scanning of copy operation is completed or not. If it is not completed, the routine returns to the main routine.

If the final scanning is completed, the routine proceeds to the step S204 to determine whether the completed scanning is scanning of a first copy operation (a first copy operation in the duplex copy mode or the composite copy mode).

If it is the first copy operation, the routine proceeds to the step S206 to set two minutes for the automatic re-setting timer.

If it is determined in the step S204 that it is not the first copy operation, the routine proceeds to the step S208 to set one minute for the automatic resetting timer.

Figure 6:
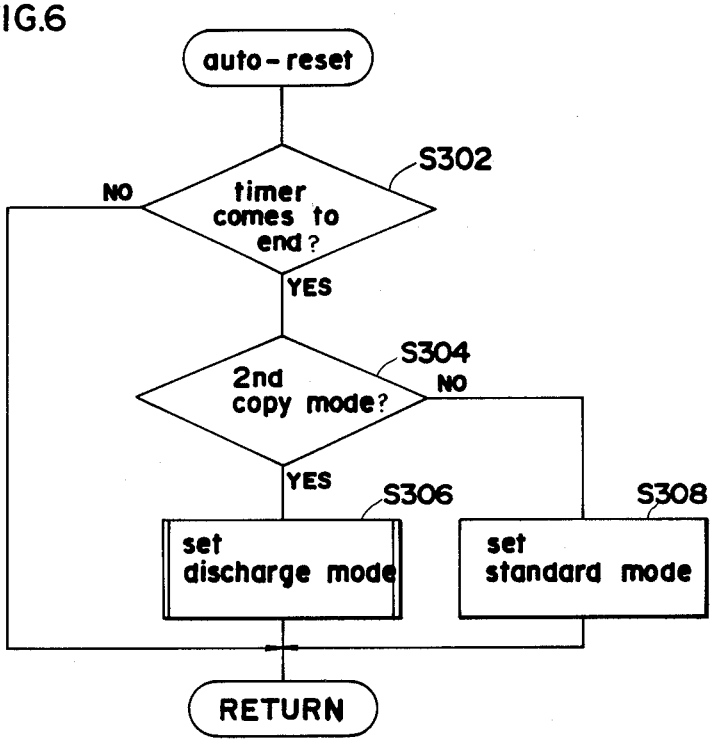
FIG. 6 is a flowchart showing the details of the step S107 shown in FIG. 4.

FIG. 6 is a flowchart showing the details of the step S107.

First, it is determined in the step S302 whether the automatic resetting timer set in the above-described step S206 or S208 shown in FIG. 5 comes to an end or not. If it does not come to an end, the routine returns to the main routine.

If it is determined in the step S302 that the above described timer comes to an end, the routine proceeds to the step S304 to determine whether the mode is a second copy mode (a second-face copy mode in duplex copy operation or a second copy mode in composite copy operation) or not. In other words, it is determined whether the apparatus is in a state ready for a second copy operation.

If it is determined in the step S304 that the second copy mode is selected, the program proceeds to the step S306 to set a second face discharge mode (a standard feed mode). This setting will be described in detail with reference to FIG. 7.

If it is determined in the step S304 that the second copy mode is not selected, the program proceeds to the step S308 to set the above-described first reference mode.

Figure 7:
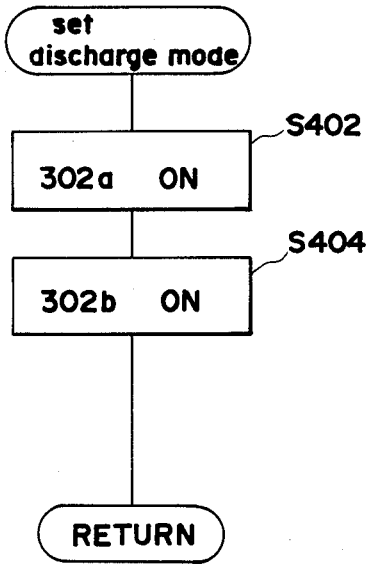
FIG. 7 is a flowchart showing the details of the step S306 shown in FIG. 6.

FIG. 7 is a flow-chart showing the details of the processing in the step S306 (setting of the second face discharge mode) shown in FIG. 6.

First, in the step S402, the display element LED 302*a* is turned on and the standard feed mode is set (a mode for discharging sheets of copy paper stored in the intermediate tray 58 without applying a copy process thereto). Then, in the step S404, the display element LED 302*b* is turned on to announce that sheets of copy paper are remaining in the intermediate tray 58.

Figure 8:
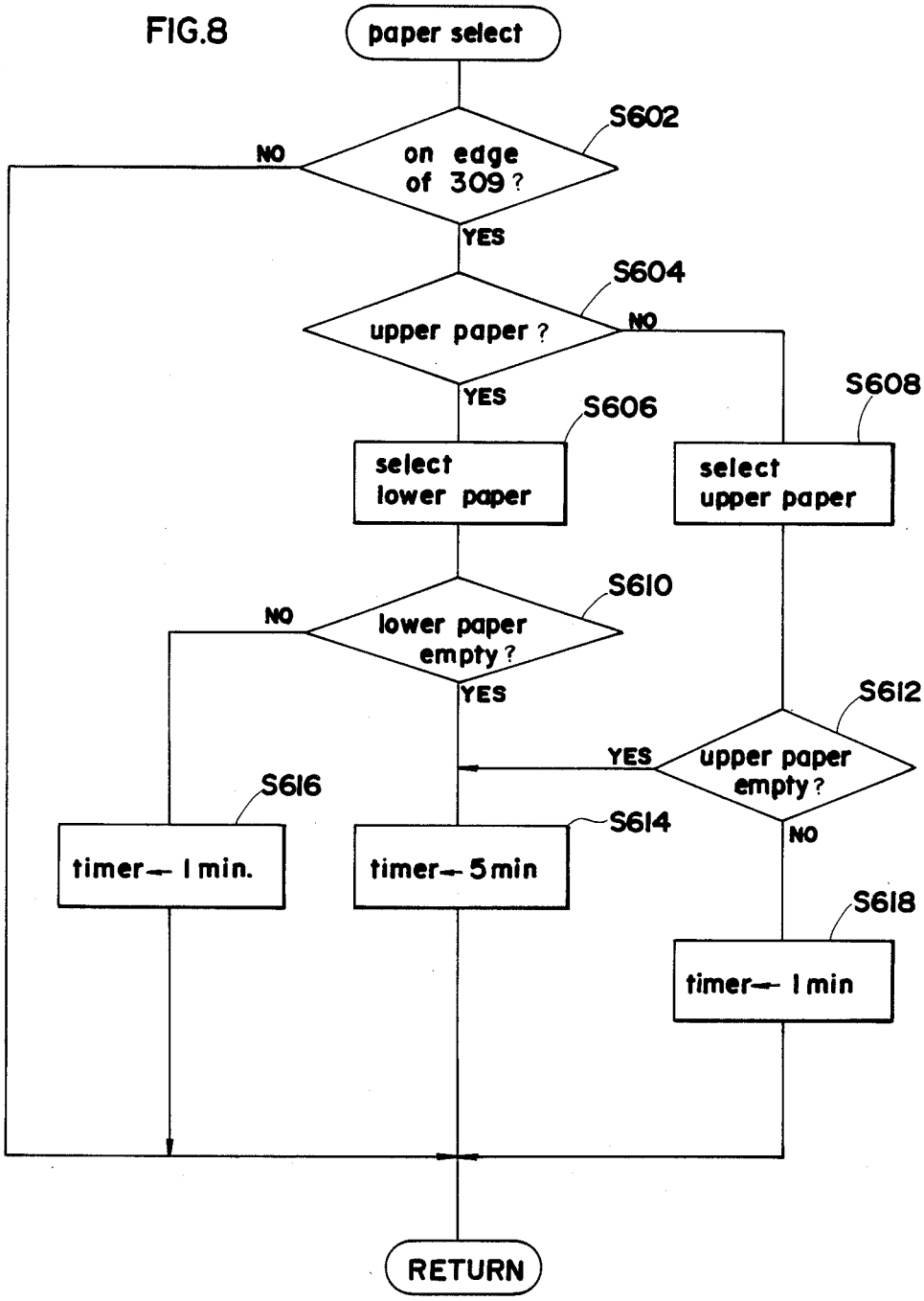
FIG. 8 is a flowchart showing the details of the step S109 shown in FIG. 4.
Figure 9A:
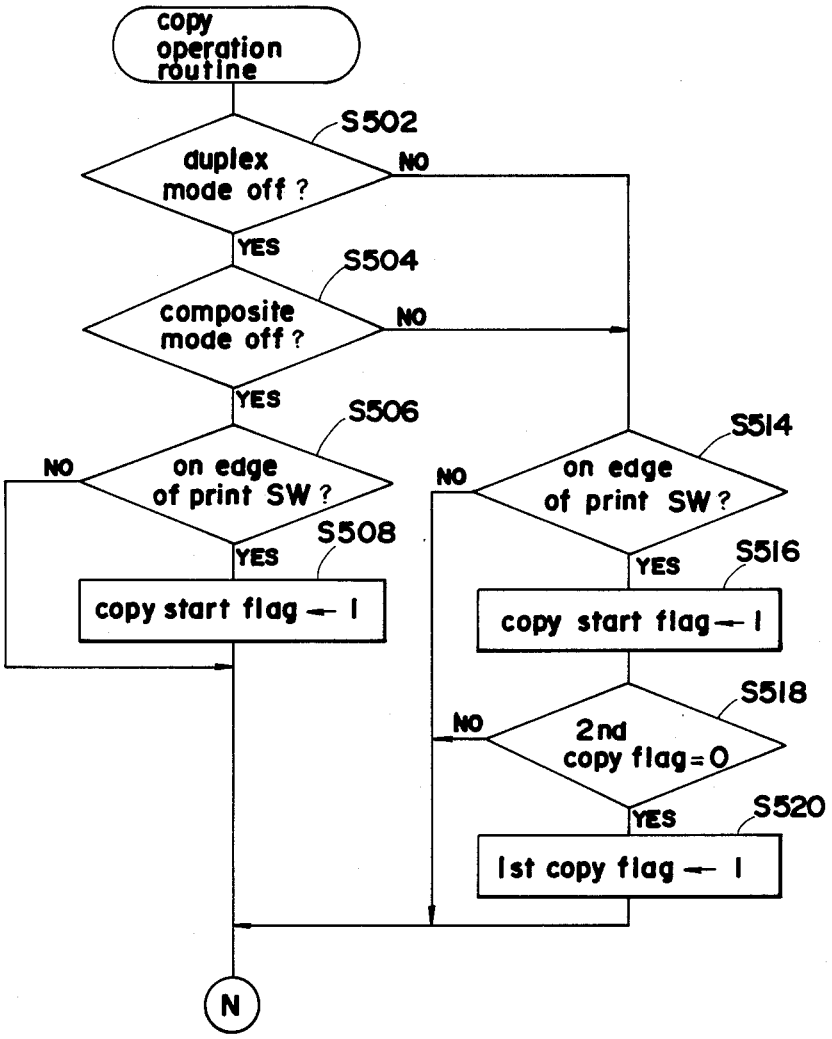
FIGS. 9A to 9D are flowchart showing the details of the processing of the step S110 shown in FIG. 4.
Figure 9B:
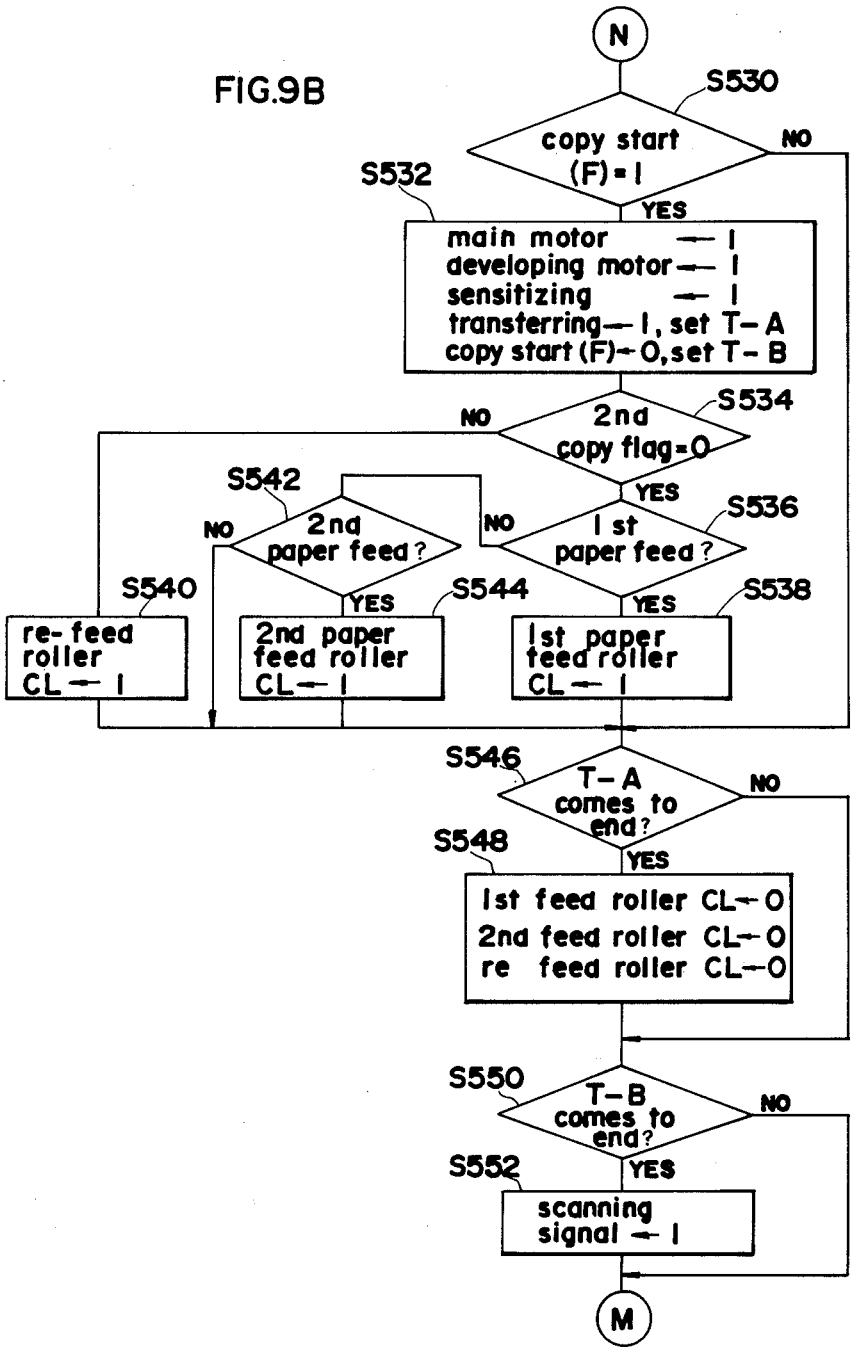
Figure 9C:
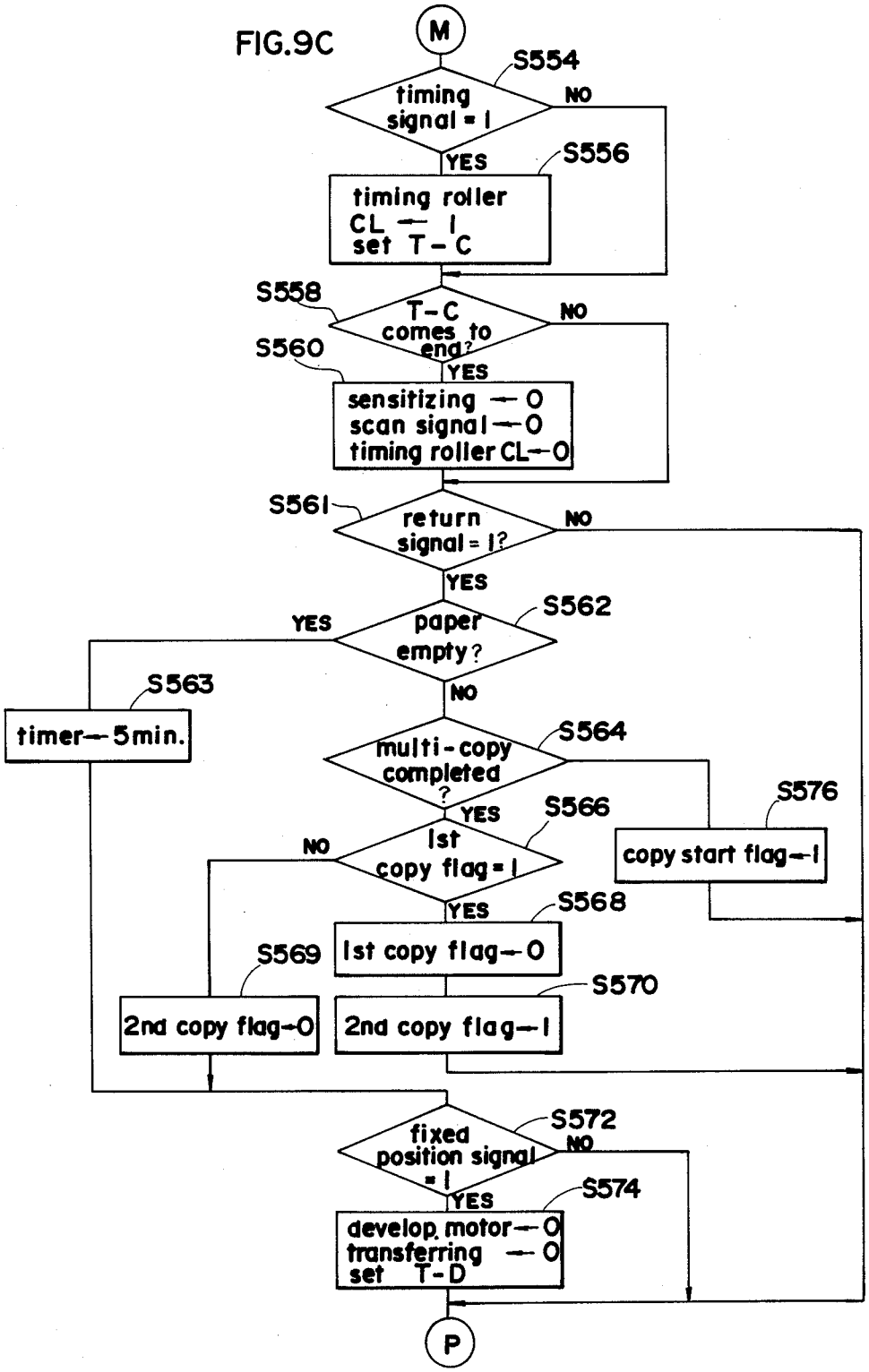
Figure 9D:
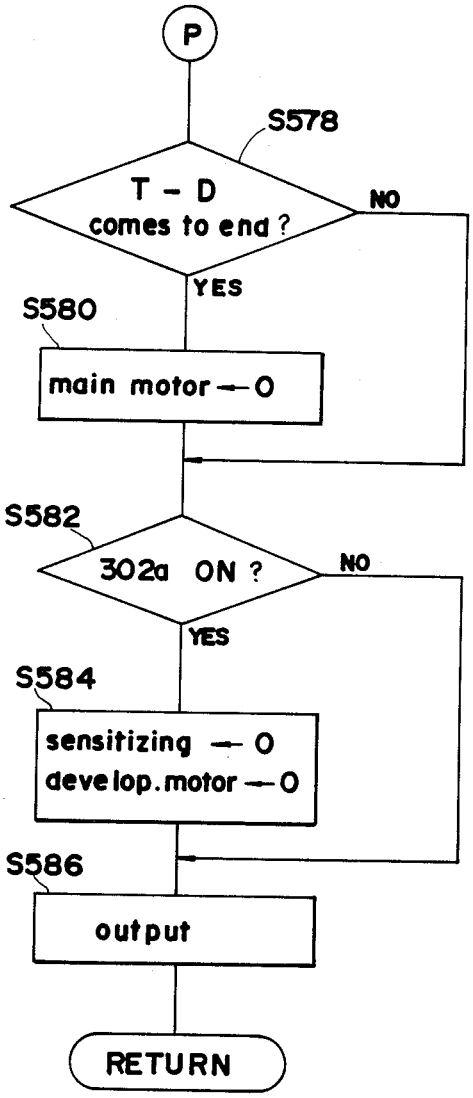

FIG. 8 is a flow-chart showing the details of the step S109.

When the paper size selection key 309 is pressed (in the step S602), it is determined whether the paper storing portion having been selected is the upper portion 42 or the lower portion 43 (in the step S604).

If it is determined that the upper paper storing portion 42 was previously selected by operation of key 309, the routine proceeds to the step S606 to select the lower paper storing portion 43 as the new paper feeding portion.

If the lower portion 43 was previously selected, the routine proceeds to the step S608 to select the upper portion 42.

Subsequently the routine proceeds from the step S606 to the step 610, wherein it is determined whether the lower storing portion 43 is empty or not. On the other hand, the routine proceeds from the step S608 to the step S612, to determine whether the upper storing portion 42 is empty or not.

If the selected paper storing portion (the upper portion 42 or the lower portion 43) is empty, the routine proceeds to the step S614 to set five minutes for the automatic resetting timer and returns to the main routine. Whereby, when the paper storing portion selected by the operation of the key 309 is empty, the copy mode will be reset to the standard mode upon a lapse of five minutes after the last key operation (in the steps S302, S304 and S308).

Conversely, when the selected paper storing portion is not empty, the routine proceeds to the step S616 or S618 to set one minute for the automatic resetting timer and returns to the main routine.

FIGS. 9A, 9B, 9C and 9D are flow-charts showing the details of the processing of the step S110 (copy operation).

The steps S502 to S508 are related with processing for starting standard copy operation (that is, copy operation in neither the duplex mode nor the composite mode). More specifically, if it is determined in the step S502 that the duplex mode is not selected and it is determined in the step S504 that the composite mode is not selected, a copy start flag is set (in the step S508) when the print key is pressed (in the step S506).

The steps S514 to S520 are related with processing for starting a first copy operation (namely, a copy operation of a first face in the duplex mode or a first copy operation in the composite mode) and a second copy operation (namely, a copy operation of a second face in the duplex mode or a second copy operation in the composite mode). Thus, a copy start flag is set (in the step S516) when the print key is pressed (in the step S514). In the first copy operation, that is, when the second copy flag is 0 (in the step S518), a first copy flag is set (in the step S520).

The steps S530 to S532 are related with processing for starting copy operation. More specifically, on condition that the copy start flag is set (in the step S530), the main motor, the developing motor, the sensitizing charger and the transfer charger are turned on. Then, the copy start flag is reset and timers A and B are set.

The steps S534 to S548 are related with processing for selecting and feeding sheets of copy paper.

More specifically, first in the step S534, it is determined whether a second copy flag is set or not. If the second copy flag is set, which means that the second face copy mode or the second copy mode of the composite mode is set, the routine proceeds to the step S540 to select a re-feed roller, whereby sheets of copy paper are fed from the intermediate tray 58.

If it is determined in the step S534 that the second copy flag is not set, the routine proceeds to the step S536 to determined whether the upper storing portion 42 is selected or not. If the upper storing portion 42 is selected, sheets of copy paper are fed from the upper storing portion 42 (in the step S538).

If the upper storing portion 42 is not selected, the routine proceeds to the step S542, so that a second paper feed roller is turned on to feed sheets of copy paper from the lower storing portion 43 on condition that the lower storing portion 43 is selected.

Then, in the step S546, on condition that the timer A comes to an end, a clutch of the paper feed roller provided in the selected paper feed portion (or the re-feed section) is turned off to stop feeding of copy paper (in the step S548).

The steps S550 to S560 are related with processing of copy operation. More specifically, on condition that the timer B comes to an end, a scanning signal for the second MPU 22 is generated to start scanning of the optical system (in the steps S550 and S552). If a timing signal is generated (in the step S554), a timing roller clutch 13 is turned on to start feeding of sheets of copy paper to the photoconductive drum 2 (in the step S556). Further, a timer C is set.

Then, if the timer C comes to an end (in the step S558), the sensitizing charger is turned off, and supply of the scanning signal is stopped and the timing roller clutch is turned off (in the step S560).

The steps S561 to S584 are steps for determining the end of copy operation, setting an automatic resetting timer in the case of a paper empty and a mode for the subsequent operation or the like. More specifically, when a return signal is generated (in the step S561) after the scanning of the optical system, it is determined whether the selected paper feed section is empty or not in the step S562. If the selected section is empty, the period of the automatic resetting timer is set to five minutes, the routine proceeds to the step S572. When multiple copy operation in a multiple copy mode is completed (in the step S564), it is determined in the step S566 whether the first copy flag is set or not.

If the first copy flag is set, which means that the copy operation just completed is the first copy operation (the first face copy operation in the duplex mode or the first copy operation in the composite mode), the program proceeds to the S568 to reset the first copy flag and to set the second copy flag in the step S570. Thus, the second copy mode is set as the subsequent mode. If it is determined in the step S566 that the first copy flag is not set, the second copy flag is reset in the step S569.

The determination in the step S566 that the first copy flag is not set means that copy operation (standard copy operation or the second copy operation in the duplex mode or the composite mode) is completed. Consequently, on condition that a fixed position signal is generated (in the step S572), the developing motor and the transfer charger are turned off and a timer D is set (in the step S574).

If it is determined in the above described step S564 that multiple copy operation is not completed, the program proceeds to the step S576 to set the copy start flag.

Then, if the timer D comes to an end (in the step S578), the main motor is stopped (in the step S580).

It is determined in the step S582 whether the standard feed mode is selected or not. If the standard feed mode is selected, the sensitizing charger and the developing motor are turned off in the step S584 so that the sheets of copy paper in the intermediate tray 58 are ready to be discharged without being printed.

Then, in the step S586, the sheets are discharged.

Thus, the copying apparatus of the embodiment of the present invention operates in the above-described manner.

Although the set period of the automatic resetting timer is five minutes in the case of the paper empty in the above described embodiment, the present invention is not limited thereto. The timer may be to any period as long as the set period of the timer in the case of the paper empty is longer than the usual set period of the timer.

In addition, although the start point of the set period of the timer is the time when the copy operation is completed or when the paper empty is detected, the timer may be started again at the time when data is input by operation of keys such as a density setting key, a magnification setting key or the like within the set period of the timer thereafter.

Further, although in the foregoing description, one of the paper storing portions is selected by the choice of position in the upper and lower portion, the present invention is not limited thereto. In practice, if desired, the storing portion may be selected by input of a paper size. In this case, the paper storing portion is provided with a paper size detecting mechanism for detecting the paper size of the copy paper therein. The paper feed portion is decided by making a comparison between the input paper size and the detected size in each of portions.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus comprising:
means for forming an image on copy paper;
means for storing copy paper;
detection means for detecting a paper empty condition in said paper storing means;
input means for inputting a copy condition;
means for giving a copy instruction;
means for automatically resetting the input copy condition to a standard state if the copy instruction is not given within a first predetermined period of time after the operation of said image forming means; and
means for maintaining the copy condition input by said input means for a second predetermined period of time, being longer than said first predetermined period of time, after the detection of the paper empty condition by said detection means and for automatically resetting the input copy condition to a standard state when said second predetermined period of timer has elapsed after detection of the paper empty condition.

2. A copying apparatus as claimed claim 1, wherein said automatic resetting means automatically resets the input copy condition to a standard state if the copy condition is not input within said first predetermined period of time after the operation of said image forming means.

3. A copying apparatus comprising:
means for forming an image on copy paper;
means for storing copy paper;
detection means for detecting a paper empty condition in said paper storing means;
input means for inputting a copy condition;
means for giving a copy instruction;
a first timer means for measuring a first set period of time after the end of the copy operation of said image forming means;
a second timer means for measuring a second set period of time after detection of the paper empty condition by said detection means, the second set period of time of said second timer means being longer than the first set period of time of said first timer means; and
means for automatically resetting the input copy condition to a standard state of the copy instruction is not given prior to expiration of either the first set period of time of said first timer means or the second set period of time of said second timer means.

4. A copying apparatus as claimed in claim 3, wherein said automatic resetting means automatically resets the input copy condition to a standard state if the copy condition is to input prior to expiration of either the first set period of time of said first timer means or the second set period of time of said second timer means.

5. A copying apparatus comprising:
means for forming an image on copy paper;
a plurality of paper storing means for storing copy paper of various sizes respectively;
detection means for detecting a paper empty condition in each of said paper storing means;
means for selecting the copy paper to be used in one of said paper storing means;
means for inputting a copy condition;
means for giving a copy instruction;
a first timer means for measuring a first set period of time after the copy operation of said image forming means;
a second timer means for measuring a second set period of time after detection of the paper empty condition by said detection means in the paper storing means selected by said selecting means, the second set period of time of said second timer means being longer than the first set period of time of said first timer means; and
means for automatically resetting the input copy condition to a standard state if a copy instruction is not given prior to expiration of either the first set period of time of said first timer means or the second set period of time of said second timer means.

6. A copying apparatus as claimed in claim 5, wherein said automatic resetting means automatically resets the input copy condition to a standard state if the copy condition is not input prior to expiration of either the first set period of time of said first timer means or the second set period of time of said second timer means.

7. A copying apparatus as claimed claim 5, wherein said paper selecting means selects the copy paper to be used by selecting one of said paper storing means.

8. A copying apparatus as claimed claim 5, wherein said paper selecting means selects the copy paper to be used by selecting one of the paper sizes.

* * * * *